United States Patent [19]

Dotti et al.

[11] Patent Number: 4,623,213

[45] Date of Patent: Nov. 18, 1986

[54] METHOD FOR JOINING TWO ALUMINUM CONDUCTORS OF ELECTRIC CABLES AND THE JOINT THUS OBTAINED

[75] Inventors: Enrico Dotti, Milan; Angelo Sala, Merate, both of Italy

[73] Assignee: Societa' Cavi Pirelli S.p.A., Milan, Italy

[21] Appl. No.: 792,506

[22] Filed: Oct. 29, 1985

[30] Foreign Application Priority Data

Nov. 27, 1984 [IT] Italy ..... 23761 A/84

[51] Int. Cl.[4] ..... H01R 4/02

[52] U.S. Cl. ..... 339/276 R; 29/873; 174/90; 339/275 R

[58] Field of Search ..... 339/275 R, 276 R; 174/84 R, 90, 94 R; 29/860, 878, 879

[56] References Cited

U.S. PATENT DOCUMENTS 2,375,741 5/1945 Dibner ..... 339/276 R
3,634,649 1/1972 Rager et al. ..... 174/90 X

FOREIGN PATENT DOCUMENTS 479958 11/1969 Switzerland ..... 339/276 R

OTHER PUBLICATIONS

"New Aluminum Process Welds", Electrical Constr. & Maint., Aug. 1958, pp. 90–92.

*Primary Examiner*—Eugene F. Desmond
*Attorney, Agent, or Firm*—Brooks Haidt Haffner & Delahunty

[57] ABSTRACT

Method for joining electrically and mechanically the multiple aluminum wires of a pair of electrical cable conductors in which the bared conductor ends are beveled and welded together and a metal sleeve, which is more rigid than the aluminum of the conductors, is applied around the weld and lengths of the conductors at each side of the weld and compressed until the sleeve has an outer size substantially equal to the size of the portions of the conductors at each side thereof. The sleeve has inner grooves for receiving displaced aluminum, and if the conductors have central channels, the channels are joined at the conductor ends by a relatively incompressible tube which fits into the channels and which may have peripheral grooves for receiving displaced aluminum. Also, a cable joint made by such method.

10 Claims, 7 Drawing Figures

Figure 1:
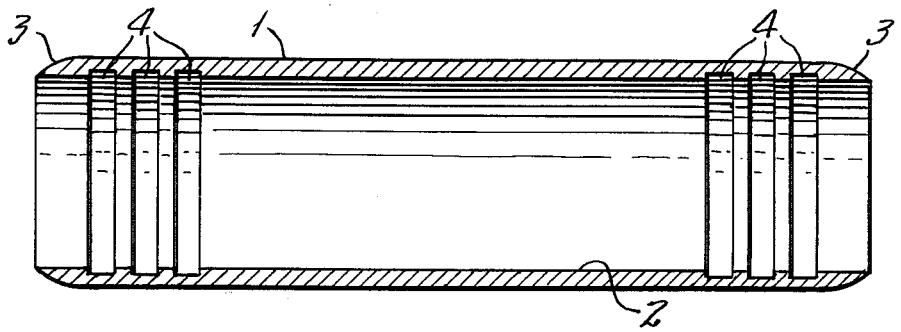

METHOD FOR JOINING TWO ALUMINUM CONDUCTORS OF ELECTRIC CABLES AND THE JOINT THUS OBTAINED

The present invention relates to a method for joining the aluminum conductors of power cables, particularly conductors formed by segmental wires or metal straps forming an internal channel for the passage of the oil in oil-filled cables, or else, conductors formed by stranded wires which do not have an internal channel. This invention also relates to the joints obtained by using said method.

The joint between two copper conductors of the type just described is effectuated, according to known techniques, by shaping in steps the ends of the conductors and by applying a deformable clamp—made of a material having a good conductivity, which is compressed radially on the conductor ends. A clamp of this type is illustrated and described in U.S. Pat. No. 4,238,639. There is thus obtained a satisfactory electrical contact between the conductors, and also good mechanical characteristics of the joint.

According to other known techniques, the copper conductors are welded to one another, and successive to this, for the purpose of locally work-hardening the material for restoring the original parameters of mechanical resistance, the welding zone is subjected to upsetting operations, with the application of at least two, equal and opposite, axial forces. See, for example, U.S. Pat. No. 3,707,865.

In some cases, the segmental wires of the oil-filled cables, or the stranded conductors of impregnated cables, are made of aluminum because this material costs less than copper and it also has a lower specific gravity. This latter advantage is of particular importance when manufacturing submarine cables which must be layed at great depths.

When the known methods of joining are applied to cables of the above-indicated type, where the conductors are made of aluminum, these joints present serious drawbacks.

In fact, the joining, by the means of a conductor sleeve internally shaped in steps, does not provide a sufficiently reliable electrical contact due to the insulating nature of the aluminum oxide which is inevitably present on the contacting surfaces of the conductors and the sleeve.

On the other hand, the joining by means of welding does not ensure the required characteristics of mechanical strength.

An object of the present invention is to provide a method, which is easy to use, for joining together two aluminum conductors of electric power cables, the resulting joint having optimum properties both from the electrical as well as from the mechanical point of view. The method of the invention provides for both an electrical as well as a mechanical connection. More precisely, the electrical connection (by welding) is of the type which eliminates the drawbacks which are due to the aluminum oxide surface-layer present on the conductors, while the mechanical connection is suitable for resisting the tensile and bending stresses which the conductor can undergo.

Another object of the invention is a joint of the type which is obtained by employing the hereinbefore described method.

The invention comprises a method for joining the aluminum conductors of two electric cables, each conductor being formed by a plurality of longitudinal elements, disposed helicoidally or twisted one with respect to the other, which method is characterized by the steps of:

(1) welding the conductors to one another;

(2) placing over the welding zone a sleeve made of a metallic material which is more rigid than the aluminum of the conductors; and (3) radially compressing the metallic sleeve for reducing its outer diameter to a value which is substantially equal to the original diameter of the conductors.

Moreover, the invention also is in the joint between two aluminum conductors of two power cables, said joint being obtained with the hereinbefore described method.

Figure 2:
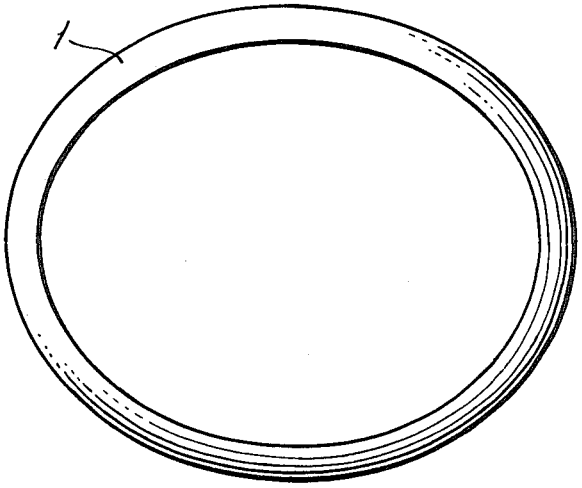
Figure 3:
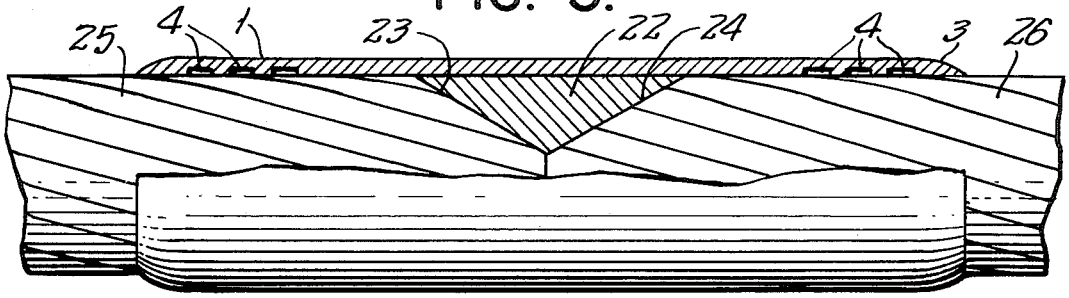
Figure 4:
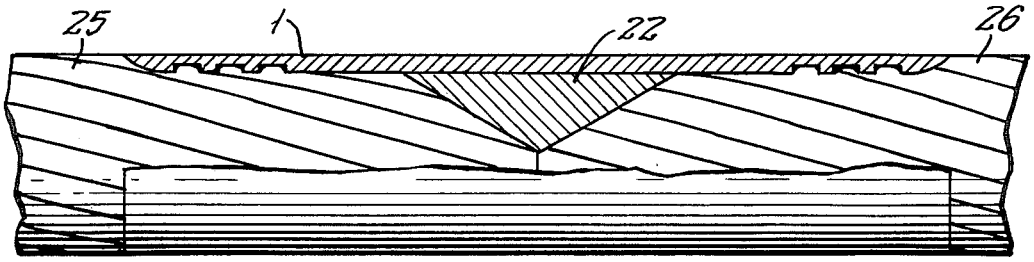
Figure 5:
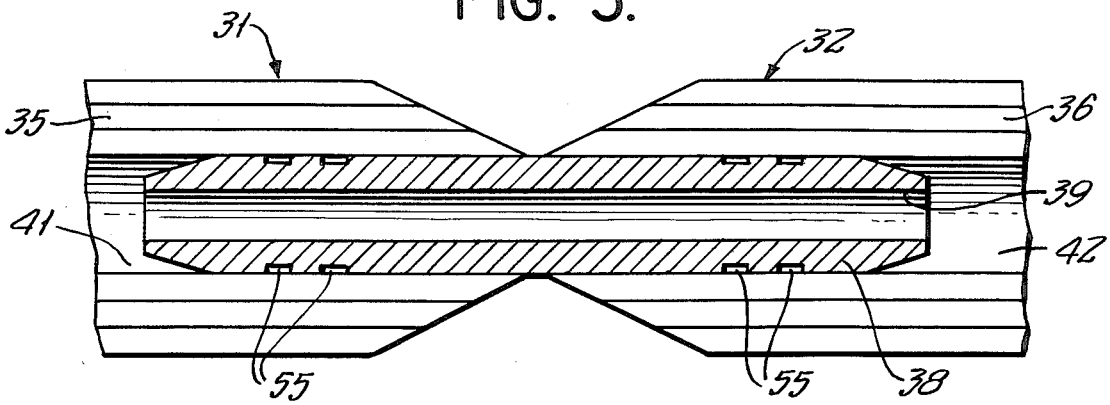
Figure 6:
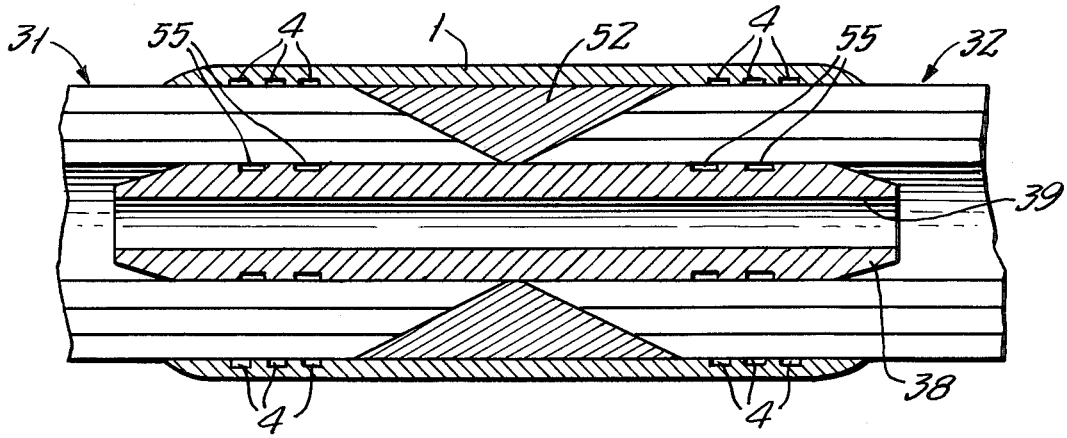
Figure 7:
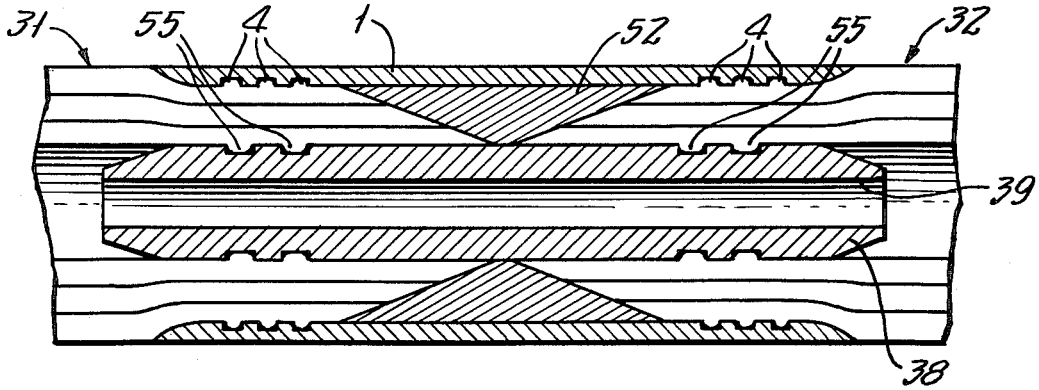

Other objects and advantages of the present invention will be apparent from the following detailed description of the presently preferred embodments thereof, which description should be considered in conjunction with the accompanying drawings in which:

FIGS. 1 and 2 are, respectively, a longitudinal cross-section view and an end view of a clamp or metallic sleeve, for realizing the joint according to the method of the invention;

FIGS. 3 and 4 illustrate steps in the application of the method to the joining of compound-impregnated cables having conductors formed out of aluminum wires and are partial, longitudinal sectional views; and FIGS. 5–7 are longitudinal cross-sectional views illustrating the steps in the application of the method of the invention to the joining of the conductors of oil-filled cables having a central oil duct.

The clamp or sleeve 1, shown in FIGS. 1 and 2, is formed by a sleeve of a metallic material which is more rigid than aluminum, preferably steel, and especially, an annealed, stainless austenitic steel. In the drawing, the sleeve section is shown as being oval since it is intended for the joining of oval conductors formed by stranded wires. However, the cross-section of the sleeve is not restricted to this shape because the cross-section of the sleeve may have any form depending upon the cross-section of the conductors to be joined. Also, the cross-section of the sleeve 1 does not have to be the same for the entire sleeve length, for example, when two cables having conductor cross-sections of different forms are joined together.

The inner surface 2 of the sleeve 1 is such as to mate with the outer surface of the conductors and, in particular, in the case of cylindrical conductors, the sleeve 1 has an internal diameter which is substantially equal to the outer diameter of the conductors. The thickness of the sleeve wall is relatively small relative to the diameter of the sleeve or to the transverse dimensions of the conductors, and the outer ends of the sleeve have taperings 3.

On the inner surface 2 of the sleeve, adjacent to the end portions, there are provided circumferentially extending recesses or grooves 4, the function of which will be described hereinafter in more detail.

With reference to the FIGS. 3 and 4, the joining method according to the invention will be illustrated in the case of two compound impregnated cables having aluminum conductors with equal cross-sections formed by stranded wires and without an inner channel.

The ends of the conductors 25 and 26 are stripped of their insulation and tapered so as to provide the two surfaces 23 and 24. Each of the surfaces can be obtained with a single bevel, for example, at 45° in the illustrated case, or else, with two or more bevels at different angles and the bevel at the end of one conductor may differ from the bevel at the end of the other conductor.

One or both of the conductors 25 and 26, preferably, only one of them, is stripped of insulation for an axial length sufficient to permit the sleeve 4 to be placed on a conductor 23 or 24 and slid therealong until an end of the sleeve 4 is axially displaced from the surface 23 or 24 and the surfaces 23 and 24 are exposed for welding purposes.

Thereafter, the two conductors 25 and 26 are abutted and are welded together, by known methods, to thereby fill the spaces delimited by the surfaces 23 and 24 with a welding material 22. Any excess of welding material is then removed until the weld area is returned to the diameter of the conductors 25 and 26. Thereupon, the clamp or sleeve 1, the length of which is such as to entirely cover the welding zone and to also extend over a length of both conductors, is slid along the conductors 25 and 26 until it is in the position shown in FIG. 3.

The applied sleeve 1 is then radially compressed in a known type of tool with a jaw formed by several sectors joined together and disposed around the periphery of the sleeve 1 until the joint has substantially the original diameter (or cross-section) of the conductors 25 and 26 as shown in FIG. 4. This means that the diameter, or in general the cross-section, in correspondence to the sleeve, has an exterior size which differs from the dimensions of the conductors only by amounts which come within the manufacturing tolerances for the conductors themselves and the joint does not create any appreciable step at the transition between conductor and sleeve. Thus, the formation of any high potential gradients, whenever the conductor is energized, is prevented.

The compression of the sleeve 1 causes the penetration of the sleeve into the underlying aluminum, and the grooves 4 are filled up with the material of the conductors 25 and 26 which flows into them thereby firmly securing the conductors 25 and 26 to the sleeve with respect to the tensile stresses.

With reference to the FIGS. 5, 6 and 7, there will now be described how the method according to the invention is utilized for effecting the joining between the oil-filled cables having a central channel or duct.

The two ends of the conductors 31, 32, each one comprising aluminum segmental wires or straps 35 and 36 that define the internal channels 41, 42 for the oil, are stripped of their insulation and tapered as described in connection with FIGS. 3 and 4 and as can be seen in FIG. 5.

A compression-resistant tubular support 38 is introduced into the internal channels 41 and 42, and connects them through an inner passage 39. Said support 38 can be provided (as shown in the figures) with external grooves 55, similar to those of the sleeve 1 for a better gripping of the inner layer of segmental wires.

Before the support 38 is introduced into either channel 41 or 42, or after it has been inserted in only one of the channels 41 or 42, the sleeve 1 is applied over one of the conductors 31 or 32 as described hereinbefore in connection with FIGS. 3 and 4. After the sleeve 1 has been so applied, the support 38 is introduced into both channels, or if it has already been inserted in one channel, it is then inserted in the other channel.

Thereafter, the two ends of the conductors 31 and 32 are abutted and welded, by known methods, and the diameter of the welding material 52 is reduced to the conductor diameter as can be seen in FIG. 6. In the same figure, the metallic sleeve 1, applied over the conductors 31 and 32 and the weld material 32 can also be seen. Said sleeve 1 is made of a material that is much harder than aluminum, for example steel, so as to have a considerable resistance to tensile and bending stresses, even in cases of a limited wall thickness. In the illustrated example, the sleeve is similar to the sleeve shown in FIGS. 1 and 2, except that it has a circular cross-section.

Finally, the sleeve 1 is radially compressed inside a pressing jaw formed by several sectors, as described hereinbefore, in such a way that, when fully compressed, the sleeve 1 will have an outer diameter substantially equal to that of the conductors 31 and 32. During the deformation of the segmental wires, the support 38 keeps the central channel open, and the grooves 4 and 55 are filled up with the compressed material, thereby mechanically engaging the metallic sleeve 4 and the support 38 with the conductors 31 and 32 and the welding material 52.

It will be apparent that the method achieves the objects of the invention. In fact, the method proves to be simple to use, not requiring any complex preliminary operations such as the shaping in steps of the conductors. Moreover, it ensures a perfect electrical contact which is not influenced by the inevitable presence of surface oxide.

At the same time, the joint is extremely resistant to the handling and installation forces due to the presence of the sleeve which, in engaging with the conductors by means of the grooves, provides the mechanical continuity of the conductors themselves. Thus, the sleeve can be subjected to bending, elongation, winding etc., as occurs in cable-life, without giving rise to any drawbacks.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. Method for joining to each other the conductors of a pair of electrical cables, each of said conductors comprising a plurality of elongated aluminum elements which are exposed at the exterior thereof, said method comprising:

tapering the end portions of each conductor with a taper with an outer surface which extends circumferentially of the axes of said conductors and with a cross-section which decreases from a larger size at a portion of said conductor spaced from the ends of said conductors to a smaller size at said ends of said conductors;

abutting and welding together with metal the ends of the conductors;

covering the welded ends and portions of the conductors at each side of the welded ends with a metal sleeve having a rigidity greater than the rigidity of the aluminum of the conductors, having an inner size as large as but substantially equal to the exterior size of said conductors in their uncompressed state so that said sleeve can be moved axially along said conductors and having an exterior size greater than said exterior size of said conductors; and compressing said metal sleeve and hence the portions of said conductors therewithin until the exterior size thereof is substantially equal to the exterior size of the portions of said conductors adjacent opposite ends and exterior to said sleeve.

2. Method as set forth in claim 1 wherein the weld metal extends over the tapered end portions of said conductors.

3. Method as set forth in claim 1 wherein the weld metal is provided with an exterior size substantially equal to said exterior size of said conductors at each side of the weld metal prior to covering the weld metal with said sleeve.

4. Method as set forth in claim 1 wherein said sleeve has a plurality of interior, circumferential grooves therein at each end thereof and wherein the compression of said sleeve causes displacement of the aluminum of said conductors into said grooves.

5. Method as set forth in claim 1 wherein said conductors have central fluid channels and wherein a metal support tube which is substantially incompressible with compression of said sleeve is inserted into said channels to join them for fluid flow prior to welding said ends of said conductor together and to covering the welded ends with said sleeve.

6. Method as set forth in claim 5 wherein said support tube has peripheral grooves at its ends and wherein compression of said sleeve causes displacement of the aluminum of said conductors into said grooves.

7. A joint between the conductors of a pair of electrical cables, each of said conductors comprising a plurality of elongated aluminum elements, said joint comprising:

tapered end portions of said conductors, the taper at said end portions having an outer surface which extends circumferentially of the axes of said conductors and a cross-section which decreases in size from a larger size at portions of said conductors spaced from the ends thereof to a smaller size at said ends of said conductors;

weld metal electrically interconnecting said tapered end portions of said conductors; and a metal sleeve around said weld metal and around and contacting portions of said conductors at each side of said weld metal, said sleeve having an exterior size substantially equal to the exterior size of the portions of said conductors at opposite ends of and exterior to said sleeve, said sleeve having a plurality of interior grooves which contain aluminum of said conductors.

8. A joint as set forth in claim 7 wherein the weld metal substantially fills the space between said tapered end portions and the interior of said sleeve.

9. A joint as set forth in claim 7 wherein said conductors have central fluid channels and further comprising a metal tube within said sleeve and interconnecting said channels for fluid flow.

10. A joint as set forth in claim 9 wherein said metal tube has peripheral grooves which contain aluminum of said conductors.

* * * * *